US005546904A

United States Patent [19]

Papenhagen et al.

[11] Patent Number: 5,546,904

[45] Date of Patent: Aug. 20, 1996

[54] MOTION TRANSMISSION MECHANISM FOR CONTROLLING AN INTERNAL COMBUSTION ENGINE

[75] Inventors: Dieter Papenhagen, Waiblingen; Thorsten Meyer, Fellbach, both of Germany

[73] Assignee: Mercedes-Benz AG, Stuttgart, Germany

[21] Appl. No.: 512,535

[22] Filed: Aug. 8, 1995

[30] Foreign Application Priority Data

Aug. 26, 1994 [DE] Germany ..... 44 30 282.7

[51] Int. Cl.[6] ..... F02D 7/00

[52] U.S. Cl. ..... 123/400

[58] Field of Search ..... 123/400, 399

[56] References Cited

U.S. PATENT DOCUMENTS

| | | | |
|---|---|---|---|
| 5,161,507 | 10/1992 | Terazawa et al. | 123/399 |
| 5,172,688 | 12/1992 | Gohring et al. | 123/399 |
| 5,191,866 | 3/1993 | Tosdale | 123/400 |
| 5,263,449 | 11/1993 | Swartzendruber | 123/400 |
| 5,297,522 | 3/1994 | Buchl | 123/399 |
| 5,339,783 | 8/1994 | Teichert | 123/400 |

FOREIGN PATENT DOCUMENTS

| | | | |
|---|---|---|---|
| 4036953C1 | 1/1992 | Germany | 123/400 |

*Primary Examiner*—Raymond A. Nelli
*Attorney, Agent, or Firm*—Klaus J. Bach

[57] ABSTRACT

In a motion transmitting mechanism for controlling a power output control member such as a butterfly valve of an internal combustion engine, wherein a control input member is operatively connected to an input lever which cooperates with an output lever by means of a projection received on a guide slot formed in the input lever, the guide slot has first and second slot sections arranged at an angle and adapted to operate the output lever and the power output control member at a relatively small motion transmission ratio with a relatively large incremental operating force increase in a lower partial load range when the projection is in the first slot section and at a relatively high motion transmitting ratio with relatively small incremental operating force increase in a higher partial load range.

3 Claims, 2 Drawing Sheets

MOTION TRANSMISSION MECHANISM FOR CONTROLLING AN INTERNAL COMBUSTION ENGINE

BACKGROUND OF THE INVENTION

The invention resides in a motion transmission mechanism for the control of an internal combustion engine which is arranged between a control member and an engine power output control element, especially a butterfly valve of the internal combustion engine and which includes at least one return spring and an input lever connected to a control input member end and an output lever connected to the engine output control element, one of the levers having a guide slot and the other having a projection received in the guide slot for the transmission of motion from one to the other of the levers and to the engine output control element for the control of the engine.

DE 40 36 956 C1 discloses a motion transmission mechanism which comprises a double-arm input lever with a projection and, cooperating therewith in the same rotational sense, an output lever adapted to operate a controller and having a guide slot receiving the projection of the input lever. The guide slot has first and second sections arranged at an angle with respect to one another which, in cooperation with the projection, provide for a reduction of the motion transmission in the partial load range of the engine and for increased motion transmission in the upper load range of the engine.

Arranged between the input lever and the output lever is a tension spring which, upon actuation of the motion transmission mechanism, is first tensioned in the partial load range represented by the first connecting link slot section but, upon load increase, is detensioned in the upper load range as represented by the second guide slot section as the distance between the mounting points of the spring is then reduced. For a reliable closing of the throttle valve return springs are utilized.

It is the object of the present invention to provide a motion transmission mechanism which is simple and more reliable and with which the mechanism can be safely returned to idle position from any lever position.

SUMMARY OF THE INVENTION

In a motion transmitting mechanism for controlling a power output control member, such as a butterfly valve, of an internal combustion engine, wherein a control input member is operatively connected to an input lever which cooperates with an output lever by means of a projection received in a guide slot formed in the input lever, the guide slot has first and second slot sections arranged at an angle and adapted to operate the output lever and the power output control member at a relatively small motion transmission ratio with relatively large incremental operating force increases in a lower partial load range when the projection is in the first slot section and at a relatively high motion transmitting ratio with relatively small incremental operating force increases in a higher partial load range.

With the particular arrangement of the mounting locations for the tension spring at one end of the input lever and at the other end, at the output lever and the particular orientation of the force line of the tension spring with respect to the projection guided in the guide slot, the tension spring is increasingly tensioned over the whole load range but, as a result of the angled arrangement of the guide slot sections, the incremental increase of spring force is smaller in the second guide slot section corresponding to the upper load range than it is in the lower load range.

Since, with the arrangement according to the invention, the tension spring is continuously tensioned from idle to the full load positions of the levers, additional return springs as they are needed for the prior art arrangements are not necessary to insure return of the output control member. Because smaller return spring forces are needed and because the incremental force increase in the upper load range is relatively small, a relatively small force is needed for the operation of the mechanism.

Upon occurrence of a malfunction of a return spring, if used, a full return of the output control member from its full load to idle position is still guaranteed.

An embodiment of the invention is described below with reference to the drawings.

DESCRIPTION OF A PREFERRED EMBODIMENT

Figure 1:
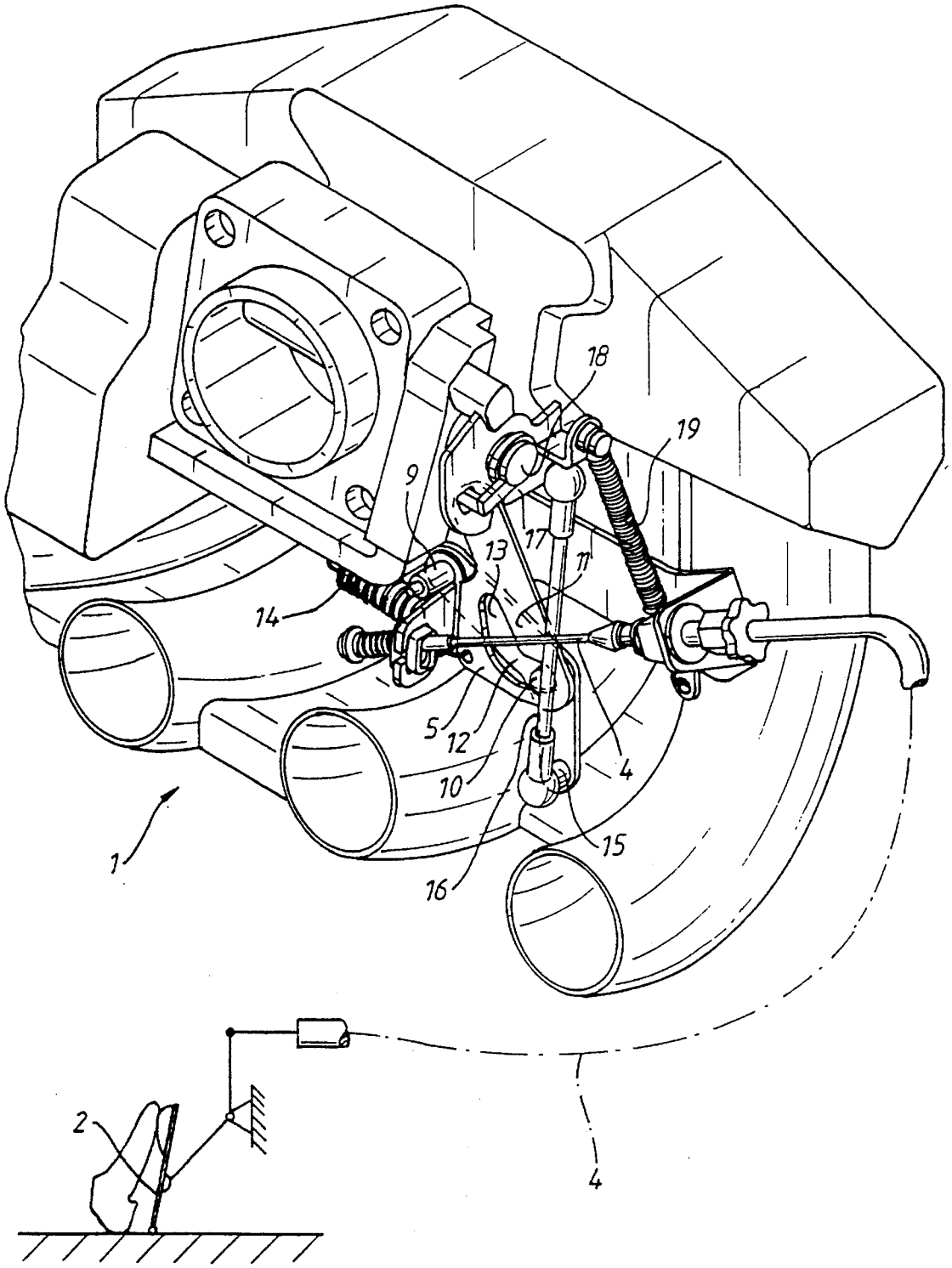
FIG. 1 is a perspective view of a motion transmission mechanism for controlling an internal combustion engine with an input lever connected to an operating element and an output lever connected to an engine power output control element.
Figure 2:
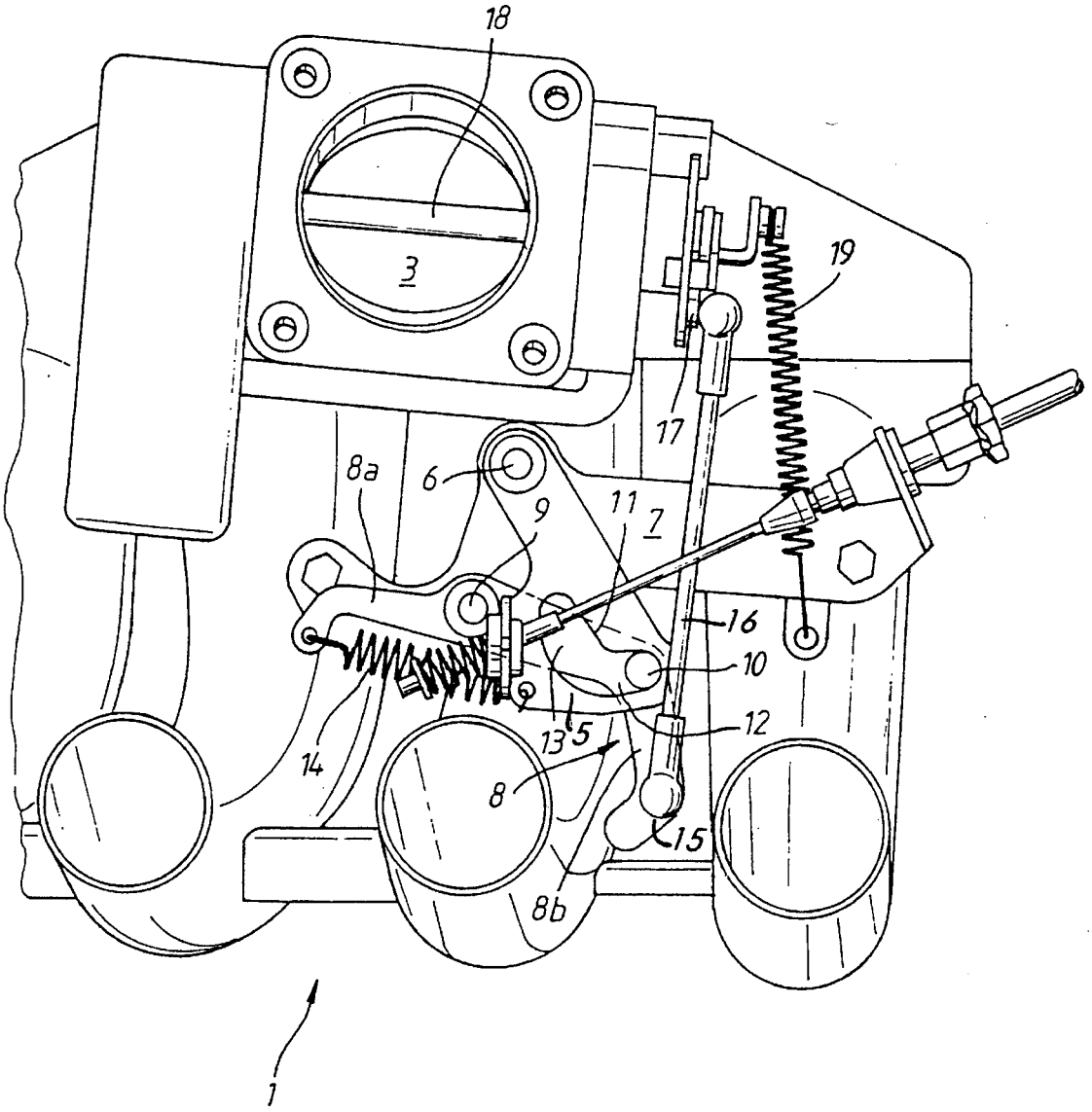
FIG. 2 is a plan view of the motion transmission mechanism.

As shown in FIG. 1, an internal combustion engine of which only the air or gas intake section 1 is represented, includes a motion transmission mechanism for transferring control motion from a control input lever 2, such as a gas pedal, to a power control member which is shown in the Figures as a butterfly valve 2. The control input lever 2 operates, by way of an operating cable, an input lever 5 which is a single-arm pivot lever supported so as to be rotatable about a shaft 6 mounted on a mounting plate 7 (FIG. 2). The input lever 5 is coupled with an output lever 8 which is rotatably supported on a shaft 9 also mounted on the mounting plate 7. The output lever 8 is a double-arm lever with a first arm **8*a* extending from the shaft 9 in one direction and a second arm 8*b* extending from the shaft 9 in the opposite direction. During operation, both levers pivot concurrently in the same sense. The second arm 8*a* of the output lever 8 has a projection provided with a roller 10 which is received in a guide slot 11 formed in the input lever 5. The guide slot 11 comprises first and second slot section 12, 13 which are arranged at an angle with respect to one another so as to define together approximately the shape of an L. The first slot section 12, consequently, extends essentially normal to the second slot section 13 and is also somewhat shorter than the second slot section 13, which extends essentially parallel to a line defined by the shaft and the roller 10 when the linkage is in engine idle position as shown in the figures. At a portion of the input lever 5 adjacent the second slot section 13, the input lever 5 is engaged by one end of a tension spring 14 whose other end is attached to the free outer end of the first arm 8*a* of the output lever 8 such that the tension spring 14 extends adjacent the first lever arm 8*a* and is slightly spaced from the shaft 9. The second lever arm 8*b* is provided, at its free end, with a pivot 15 engaged by one end of an operating rod 16 whose other end engages an intermediate lever 17 connected to a shaft 18 of the throttle valve 3. The intermediate lever 17 is engaged by a return spring 19** mounted so as to return the throttle valve to its closed position.

The roller 10 is disposed between the pivot 15 and the shaft 9 of the output lever 8 such that the direction of movement of the roller 10 while moving within the first slot section 12 of the guide slot 11 is essentially in line with the force direction of the tension spring 14 in all positions of the input and output levers 5 and 8.

After transition of the roller 10 from the first slot section 12 to the second slot section 13 of the guide slot 11, the roller 10 is increasingly removed from the force line of the spring 14 and comes closer to the shaft 6 of the input lever 5.

A particular angular movement of the input lever 5, therefore, results in larger angular movement of the output lever 8 when the roller 10 is in the second slot section than it does when the roller 10 is in the first slot section. Consequently, the motion transmission ratio is relatively small as long as the roller 10 moves in the first slot section 12, that is, in the engine's lower partial load range with a certain increase in the force of the tension spring 14. Further movement of the roller 10 in the upper partial load range, that is when the roller 10 moves through the second slot section 13, results in a greater motion transmission with reduced lengthening spring 14.

With regard to the operation of the butterfly valve 3, this means that, in the upper partial load range, a particular input member control movement results in a relatively small change in operating force on the control input member 2.

With the particular intermediate spring control a relatively large lever return force is provided in the lower partial load range while a low operating force is required in the upper partial load range. Over the whole operating range, the force requirements change smoothly and the load on the roller 10 in the guide sleeve is relatively low.

What is claimed is:

1. A motion transmission mechanism for transmitting motion between a control input member and a power output control member, such as a butterfly valve, which is spring biased into an idle position for controlling an internal combustion engine, comprising: an input lever pivotally mounted on a first support shaft and operatively connected to said control input member, an output lever pivotally mounted on a second support shaft spaced from said first support shaft, one of said input and output levers having a guide slot and the other having a projection received in said guide slot for cooperating movement of said input and output levers in the same said direction, said guide slot comprising first and second slot sections arranged at an angle with regard to each other, said first section guiding said projection in a lower partial load range of said engine so as to provide for a small ratio of motion transmission from said input lever to said output lever and said second section guiding said projection in an upper partial load range of said engine so as to provide for a large ratio of motion transmission from said input lever to said output lever such that any incremental position change of said input lever causes a small position change of said power output control member in said lower partial load range and a large position change of said power output control member in said upper partial load range, said output lever being a double armed lever having first and second arms, a tension spring having one end connected to the free end of said first arm and an operating rod having one end operatively connected to the end of said second arm and the other to said engine power output control member, said tension spring having its other end connected to said input lever at such a location that a line of force of said spring extends essentially in a direction of movement of said projection within said first slot section of said guide slot, thereby increasing a tension of said tension spring at a high rate while causing small movement of said output lever, and that the line of force of said spring extends at an angle to the direction of movement of said projection within said second slot section of said guide slot so as to increase the spring tension at a low rate while causing large movement of said output lever with a concurrent small spring tension increase.

2. A motion transmission mechanism according to claim 1, wherein said guide slot is formed in said input lever and said projection is a roller mounted on said output lever between the pivot shaft of said output lever and the connection of said operating rod to said output lever and received in said guide slot in said input lever.

3. A motion transmission mechanism according to claim 2, wherein said second slot section of said guide slot is essentially parallel to a line extending between the pivot shaft of said input lever and said projection when said mechanism is in idle position and the first slot section extends essentially normal to said second slot section such that said first and second slot sections define an L shape.

* * * * *